US005642576A

United States Patent [19]

Chrisman

[11] Patent Number: 5,642,576

[45] Date of Patent: Jul. 1, 1997

[54] SUCTION DREDGE PUMP APPARATUS

[76] Inventor: Joe Chrisman, P.O. Box 97, Fort Towson, Okla. 74735

[21] Appl. No.: 595,638

[22] Filed: Feb. 2, 1996

[51] Int. Cl.[6] ..... F04B 19/00

[52] U.S. Cl. ..... 37/317; 417/389

[58] Field of Search ..... 37/316, 317, 900, 37/901, 903; 123/3, 198 F, 445, 568, 557, 575; 417/473, 269, 394, 389; 92/13.7

[56] References Cited

U.S. PATENT DOCUMENTS

| | | | |
|---|---|---|---|
| 2,363,410 | 11/1944 | Gill, Sr. | 417/473 |
| 2,419,775 | 4/1947 | Hazard | 417/473 |
| 2,809,868 | 10/1957 | Thompson | 417/473 |
| 2,951,450 | 9/1960 | Fisher | 417/473 |
| 3,382,811 | 5/1968 | Chastang et al. | 417/473 |
| 3,598,505 | 8/1971 | Greene et al. | 417/330 |
| 3,637,330 | 1/1972 | Goeldner | 417/389 |
| 4,023,518 | 5/1977 | Fahrner | 114/244 |
| 4,232,903 | 11/1980 | Welling et al. | 299/8 |
| 4,267,652 | 5/1981 | Senesac | 37/317 |
| 4,302,163 | 11/1981 | Hope et al. | 417/473 |
| 4,723,894 | 2/1988 | Marx | 417/269 |
| 4,759,664 | 7/1988 | Deal | 405/258 |
| 4,895,494 | 1/1990 | Gardner | 417/239 |
| 4,902,206 | 2/1990 | Nakazawa et al. | 417/394 |
| 5,002,154 | 3/1991 | Chen | 184/1.5 |
| 5,351,705 | 10/1994 | Reinders et al. | 137/12 |

*Primary Examiner*—Terry Lee Melius
*Assistant Examiner*—Robert Pezzuto
*Attorney, Agent, or Firm*—John R. Flanagan

[57] ABSTRACT

A suction dredge pump apparatus includes a manifold having a body defining a plurality of compartments, an intake chamber disposed adjacent to the compartments along upper ends thereof, a plurality of intake valves connected to the upper ends of the compartments, and a plurality of outlet valves connected to lower ends of the compartments. The compartments have bottoms which slope downward from the upper ends to the lower ends thereof so as to produce gravity flow of a fluid mixture therethrough. The apparatus also includes a plurality of drums deformable between expanded and contracted conditions, conduits connecting the drums with the tops of the compartments, and a motion transmitting arrangement pivotally connected to the drums for repetitively rotatably moving through a rotation cycle to cause deformation of the drums between expanded and contracted conditions for producing vacuum and positive pressurized conditions at separate times in each of the compartments to cause entry of the flow of the fluid mixture into the compartments from the intake chamber via the intake valves in response to producing the vacuum condition therein and exit of the flow of the fluid mixture from the compartments to the discharge area via the outlet valves in response to producing the positive pressurized condition therein.

21 Claims, 2 Drawing Sheets

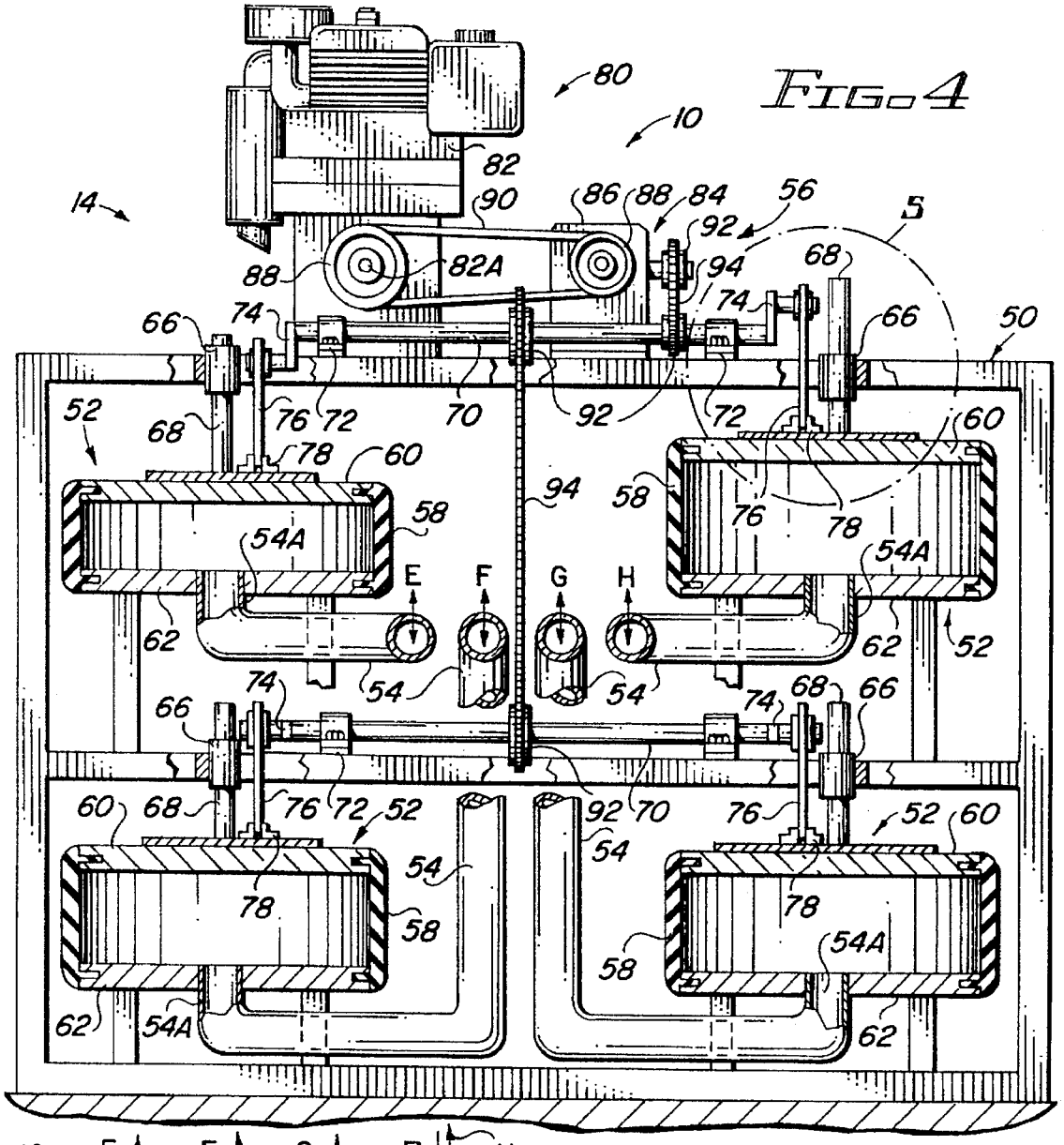
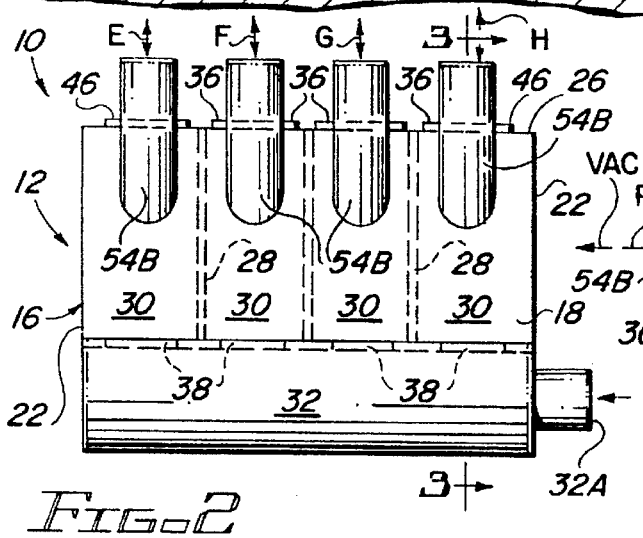
FIG. 2
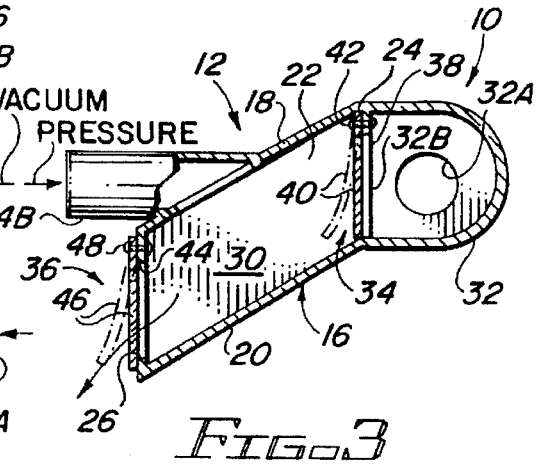
FIG. 3

SUCTION DREDGE PUMP APPARATUS

BACKGROUND OF THE INVENTION

1. Field of the Invention

The present invention generally relates to pumps and, more particularly, is concerned with a suction dredge pump apparatus having a plurality of expandable and contractible drums connected to separate compartments of a manifold through which the fluid mixture being pumped flows.

2. Description of the Prior Art

The use of heavy equipment, such as bulldozers, backhoes and loaders is common in large scale mining operations. However, investment in such heavy equipment is not economically feasible in small scale placer mining. Instead, a less expensive means, such as a pump, may be utilized to lift a fluid mixture, such as water, sand, gravel and dirt, from a riverbed or other location to a discharge area where gold or another desired material may be separated from the other components of the fluid mixture.

A screw-type pump or an impeller-type pump could be employed to lift the fluid mixture from the riverbed to the discharge area, but the sand, gravel and dirt of the fluid mixture is likely to have an undesirable adverse effect on the screw or impeller. Therefore, it is desirable that there be no contact between the fluid mixture and the means used to lift the fluid mixture from the riverbed to the discharge area.

Bellows-type pumps utilizing a plurality of bellows that are expanded and contracted in a cycle to achieve a relatively uniform flow of fluid are known in the prior art. One example of this type of pump is disclosed in U.S. Pat. No. 2,363,410 to Gill, Sr. The bellows-type pump of Gill, Sr. has four bellows that reach maximum compression and expansion at different successive quarter revolutions of a shaft to achieve a relatively continuous flow of fluid from the pump. However, in this pump, the fluid that is being pumped has to enter the bellows. This requirement would likely make the Gill, Sr. pump unsuitable for application in a placer mining operation where the sand, gravel and dirt of the fluid mixture, by entering the bellows, would be likely to cause serious damage to the pump.

Consequently, the need exists for a pump which will avoid the drawbacks of the prior art and be suitable for small scale mining operations.

SUMMARY OF THE INVENTION

The present invention provides a suction dredge pump apparatus designed to satisfy the aforementioned need by avoiding the drawbacks of the prior art without introducing other drawbacks. Accordingly, the present invention is directed to a suction dredge pump apparatus for pumping a fluid mixture such as water, sand, gravel and dirt, which comprises a manifold having a body defining a plurality of compartments, an intake chamber disposed adjacent to the compartments along upper ends thereof, a plurality of intake valves connected to the upper ends of the compartments, and a plurality of outlet valves connected to lower ends of the compartments. The compartments have bottoms which slope downward from the upper ends to the lower ends thereof so as to produce gravity flow of the fluid mixture therethrough. The apparatus also comprises a plurality of drums deformable between expanded and contracted conditions, a plurality of conduits connecting the drums with the tops of the compartments, and a motion transmitting arrangement pivotally connected to the drums for repetitively rotatably moving through a rotation cycle to cause deformation of the drums between expanded and contracted conditions for producing vacuum and positive pressurized conditions at separate times in each of the compartments to cause entry of flow of the fluid mixture into the compartments from the intake chamber via the intake valves in response to producing the vacuum condition therein and exit of flow of the fluid mixture from the compartments to the discharge area via the outlet valves in response to producing the positive pressurized condition therein.

One feature of the apparatus of the present invention is that the bottom of each compartment is sloped downward from the upper end to the lower end thereof. This feature causes the flow of fluid mixture entering into the compartments of the manifold through the intake valves from the intake chamber to flow by gravity down the bottoms of the compartments and out through the outlet valves on the lower ends of the compartments to the discharge area.

Another feature of the apparatus of the present invention is that the motion transmitting arrangement produce deformation of the drums between the expanded and contracted conditions during each cycle of rotation thereof. When the drums are expanded a vacuum condition is applied to the compartments causing vacuum suction flow of the fluid mixture from the intake chamber through the intake valves into the separate compartments. When the drums are contracted a positive pressurized condition is applied to the compartments causing positive pressurized flow of the fluid mixture from the compartments through the outlet valves to the discharge area.

A further feature of the apparatus of the present invention is that the motion transmitting members are linked to the drums so as to cause expansion and contraction at different successive time intervals during each rotation cycle thereby causing vacuum suction flow into and positive pressurized flow out of each compartment at different successive time intervals during each rotation cycle. For example, the manifold can have four separate compartments and thus four separate drums are connected to the four compartments of the manifold. At the start of each rotation cycle and at ninety degrees therefrom during each three hundred sixty degree cycle, a first drum is fully contracted, a second drum is contracting, a third drum is expanding and a fourth drum is fully expanded. Thus, at the start of each rotation cycle and each ninety degree increment therefrom during each cycle, flow of the fluid mixture out of a first compartment is completed, flow of the fluid mixture out of a second compartment is occurring, flow of the fluid mixture into a third compartment is occurring and flow of the fluid mixture into a fourth compartment is completed. This feature results in a relatively uniform and continuous flow of fluid mixture from the common intake chamber to the discharge area because there is flow of the fluid mixture into and out of at least one compartment at any given time during the rotation cycle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 2 is a top plan view of a manifold of the suction dredge pump apparatus.

FIG. 3 is a cross-sectional view of the manifold of the suction dredge pump apparatus taken along line 3—3 in FIG. 2.

FIG. 4 is a side elevational view, partly in section, of expandable and contractable drums, conduits, motion transmitting members and drive arrangement of the suction dredge pump apparatus.

DETAILED DESCRIPTION OF THE INVENTION

Figure 1:
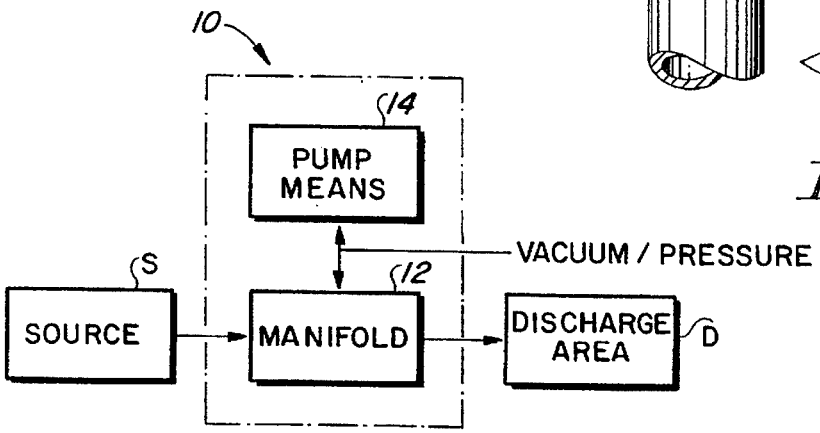
FIG. 1 is a block diagram of a suction dredge pump apparatus of the present invention.

Referring to the drawings, and particularly to FIGS. 1, 2 and 4, there is illustrated a suction dredge pump apparatus of the present invention, generally designated 10. The pump apparatus 10 is designed for pumping a fluid mixture, such as water, sand, gravel and dirt and the like, and thus is particularly adapted, although not limited, for use in a small scale placer mining operation. As represented in block diagram form in FIG. 1, the pump apparatus 10 basically includes a manifold 12 and pump means 14 connected to the manifold 12 to vacuum suction a flow of the fluid mixture from a source S thereof, such as a stream bed or the like, into the manifold 12, gravity feed the fluid mixture through the manifold 12, and discharge the fluid mixture from the manifold 12 to a discharge area D, such as a location where a desired ore in the fluid mixture is being separated out prior to discarding of the tailings of the fluid mixture.

Referring to FIGS. 2 and 3, the manifold 12 of the pump apparatus 10 includes an enclosure body 16 having a top wall 18, a bottom wall 20, a pair of opposite side walls 22, and a pair of opposite upper and lower end walls 24, 26. The opposite side walls 22 of the body 16 extend between and are rigidly connected with the top and bottom walls 18, 20, and the opposite upper and lower end walls 24, 26 of the body 16 extend between and are rigidly connected with the top and bottom walls 18, 20 and the opposite side walls 22. The manifold body 16 also has a plurality of interior partition walls 28 extending between and rigidly connected with the top and bottom walls 18, 20 and the upper and lower end walls 24, 26. The inner partition walls 28 are laterally spaced apart from one another and from the opposite side walls 22 so as to define a plurality of separate compartments 30 within the enclosure body 16 extending between the upper and lower end walls 24, 26. Adjacent portions of the upper and lower end walls 24, 26 of the body 16 define opposite first and second ends of the respective compartments 30. The top and bottom walls 18, 20 of body 16 slope or are inclined downward from the upper end wall 24 to the lower end wall 26 and adjacent portions of the bottom wall 20 define sloped bottoms of the respective compartments 30.

Referring still to FIGS. 2 and 3, the manifold 12 also includes an intake chamber 32, a plurality of intake valves 34 disposed at the first ends of the respective compartments 30, and a plurality of outlet valves 36 disposed at the second ends of the respective compartments 30. The intake chamber 32 is connected to the exterior side of the upper end wall 24 of the enclosure body 16 adjacent to and extending along the first ends of the compartments 30 of the body 16. The intake chamber 32 having an inlet 32A for connecting to the source S of the fluid mixture which is external of the manifold 12. The intake chamber 32 also has an outlet 32B which is common to and co-extensive with all of the intake valves 34 of the body 16.

The intake valves 34 of the manifold 12 are operable to provide flow communication from the intake chamber 32 into the respective compartments 30 of the body 16. Each intake valve 34 is disposed relative to its respective compartment 30 to assume an opened position in response to the pump means 14 producing a vacuum condition in the respective compartment 30 and a closed position in response to the pump means 14 producing a positive pressurized condition in the respective compartment 30.

More particularly, each intake valve 34 includes an inlet opening 38 defined in the first end of the respective compartment 30, and an inlet closure member 40 mounted to the upper end wall 24 of the body 16 by any suitable means, such as a fastener 42, adjacent to the first end of the respective compartment 30. The inlet closure member 40 is adapted to move to the opened position relative to the inlet opening 38, as seen in dashed line form in FIG. 3, in response to the vacuum condition being produced in the respective compartment 30. The inlet closure member 40 is also adapted to move to the closed position relative to the inlet opening 38, as seen in solid line form in FIG. 3, in response to the positive pressurized condition being produced in the respective compartment 30.

The outlet valves 36 of the manifold 12 are operable to provide flow communication from the separate compartments 30 to the discharge area D exterior of the manifold 12. Thus, the respective flows of the fluid mixture having entered the compartments 30 of the body 16 through the intake valves 34 from the intake chamber 32 will move or flow under the influence of gravity down the inclined bottom wall 20 of the body 16 and exit the compartments 30 through the outlet valves 36 to the discharge area D. Each outlet valve 36 is disposed relative to its respective compartment 30 to assume a closed position in response to the pump means 14 producing the vacuum condition in the respective compartment 30 and an opened position in response to the pump means 12 producing the positive pressurized condition in the respective compartment 30.

More particularly, each outlet valve 36 includes an outlet opening 44 defined in the second end of the respective compartment 30, and an outlet closure member 46 mounted to the lower end wall 26 of the body 16 by any suitable means, such as a fasterner 48, adjacent to the second end of the respective compartment 30. The outlet closure member 46 is adapted to move to the closed position relative to the outlet opening 44, as seen in solid line form in FIG. 3, in response to the vacuum condition being produced in the respective compartment 30. The outlet closure member 46 also is adapted to move to the opened position relative to the outlet opening 44, as seen in dashed line form in FIG. 3, in response to the pressurized condition being produced in the compartment 30. In one exemplary form, the intake and outlet valves 34, 36 are flapper-type valves wherein the closure members 40, 46 of the respective intake and outlet valves are flexible so as to permit their movement between the opened and closed positions relative to the respective inlet and outlet openings 38, 44.

Figure 5:
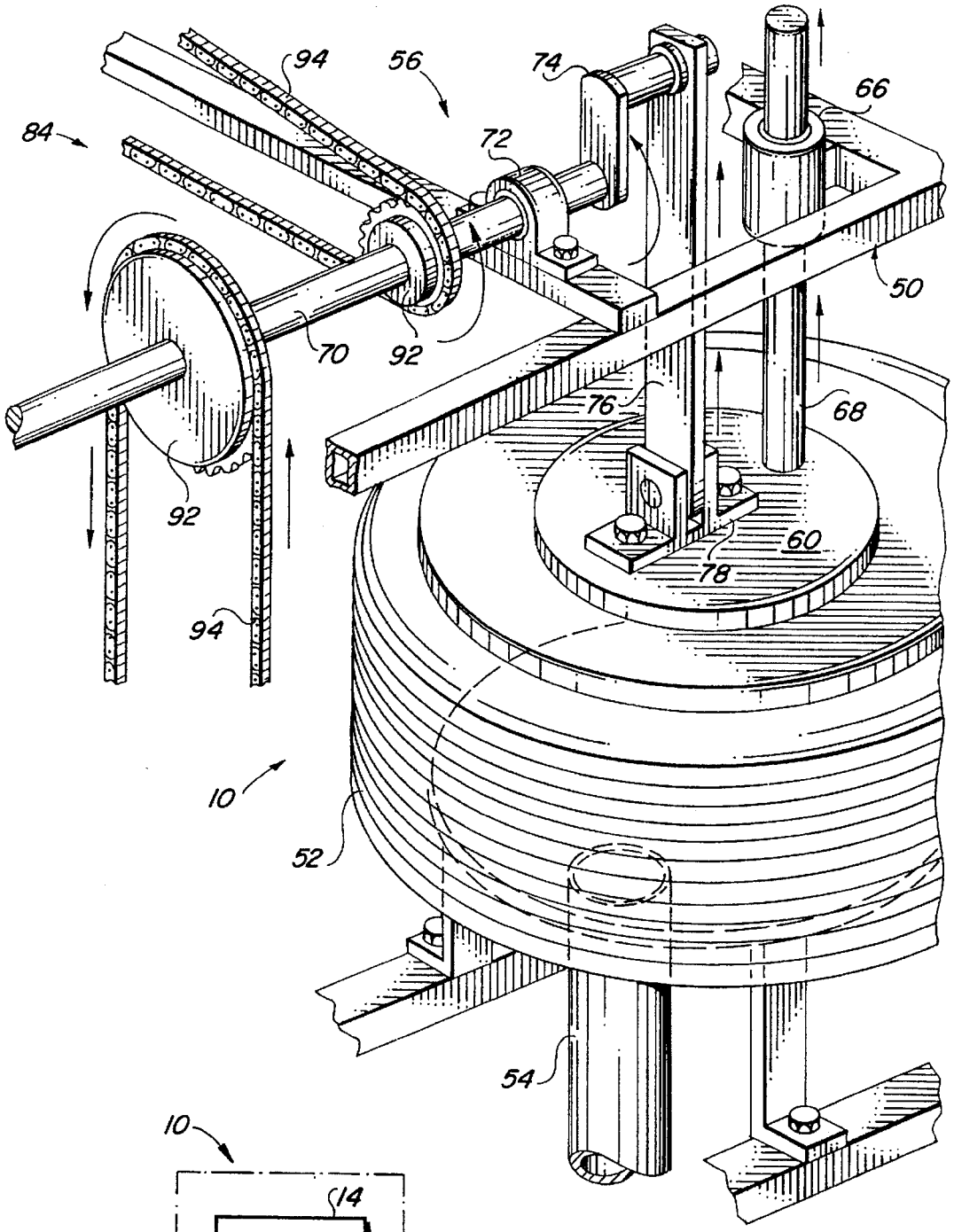
FIG. 5 is an enlarged fragmentary perspective view of the portion of the suction dredge pump apparatus encompassed by circle 5 in FIG. 4.

Referring to FIGS. 4 and 5, the pump means 14 of the apparatus 10 is connected to each of the compartments 30 of the manifold body 16 and is operable for producing the respective vacuum and positive pressurized conditions at separate times in each of the compartments 30 and for cycling between the vacuum and positive pressurized conditions. Fluid mixture flow enters into the intake chamber 32 from the source S and therefrom into each of the compartments 30 from the intake chamber 32 via the corresponding one of the intake valves 34 upon the operation of the pump means 14 producing the vacuum condition therein. Also, fluid mixture flow exits from each of the compartments 30 to the discharge area D via the corresponding one of the outlet valves 36 upon the the operation of the pump means 14 producing the positive pressurized condition therein.

More particularly, the pump means 14 includes a frame 50, a plurality of drums 52, a plurality of conduits 54 and actuating means 56. The drums 52 are deformable between expanded and contracted conditions and have opposite ends which are sealably closed. As an example, the drums 52 can take the form of deformable vehicle tire carcasses 58 with pairs of upper and lower plate members 60, 62 attached to and sealably closing opposite upper and lower ends of the respective tire carcasses to form the opposite ends of the drums 52. Each of the drums 52 is supported on the frame 50 by posts 64 fixed thereon and to the lower plate member 62 of the drum 52. Also, an upper end 54A of each of the conduits 54 is connected to the lower plate member 62 of a respective one of the drums 52 so as to communicate with the interior sealed cavity 52A of the respective drum 52. The opposite lower end 54B of each of the conduits 54 is connected to the top wall 18 of the body 16 of the manifold 12 so as to communicate with a respective one of the compartments 30 thereof. The arrows E, F, G, H in FIGS. 3 and 4 are used to identify the correspondence of the respective conduits 54 shown in FIG. 3 with those shown in FIG. 4.

The actuating means 56 of the pump means 14 is connected to the upper plate members 60 which close the upper ends of the respective drum carcasses 58. The actuating means 56 is operable for producing deformation of the drums 52 between their contracted and expanded conditions for producing the respective vacuum and positive pressurized conditions at separate times in each of the compartments 30 of the manifold 12. The actuating means 56 also is operable for cycling between the vacuum and positive pressurized conditions in the compartments 30 of the manifold 12 at different successive time intervals to produce a relatively continuous flow of the fluid mixture through the manifold 12 from the source S of fluid mixture to the discharge area D.

More particularly, the actuating means 56 includes a plurality of tubular guide members 66 each respectively rigidly attached to the frame 50 adjacent to and spaced from the upper plate member 60 of a respective one of the drums 52, and a plurality of elongated guide rods 68 each rigidly attached at one end to the upper plate member 60 of the respective one drum 52 and extending perpendicular therefrom and aligned along the central axis of the respective drum 52. The guide rods 68 slidably extend upwardly through the respective tubular guide members 66 and thus slidably movable through and relative the guide members 66 so as to restrict the upper end of the carcass 58 of the respective one drum 52 to axial movement toward and away from the opposite lower end of the carcass 58 and thereby deformation of the drum 52 between the expanded and contracted conditions.

The actuating means 56 also includes a plurality of motion transmitting members 70 rotatably supported on the frame 50 by bearings 72 and including crank arms 74 attached to and extending radially from opposite ends of the motion transmitting members 70, and a plurality of links 76 pivotally connected at opposite ends to the crank arms of the respective motion transmitting members 70 and to brackets 78 fixed on the upper plate members 60 of the respective drums 52. Rotation of the motion transmitting members 70 produces deformation of the respective drums 52, via the interconnections provided by the crank arms 74 and links 76, between the respective expanded and contracted conditions during each cycle of the rotation, causing vacuum suction flow of the fluid mixture into the compartments 30 of the manifold body 16 via the intake valves 34 in response to the expansion of the drums 52 and positive pressurized flow of the fluid mixture from the compartments 30 via the outlet valves 36 in response to the contraction of the drums 52. In view that the respective crank arms 74 are angularly displaced ninety degrees from one another at their respective radial positions about the motion transmitting members 70, the expansions and contractions of the drums 52 and thus the application of the vacuum and positive pressurized conditions in the compartments 30 occur at different successive time intervals during each rotation cycle of the motion transmitting members 70. Specifically, the crank arms 74 on the upper motion transmitting member 70 are displaced 180 degrees from one another. Similarly, the crank arms 74 on the lower motion transmitting member 70 are displaced 180 degrees from one another and 90 degrees from the crank arms 74 on the upper motion transmitting member 70.

The actuating means 56 further includes a drive arrangement 80 connected to the motion transmitting members 70 for repetitively rotatably driving the motion transmitting members 70 through the rotation cycle. The drive arrangement 80 includes an engine 82 and a drive train 84 drivinging connecting an output shaft 82A of the engine 82 and the motion transmitting member 70. The drive train 84 is composed of a gear box 86, a pair of pulleys 88 and a belt 90 entrained over the pulleys 88 for transmitting rotary motion from the enginer output shaft 82A to the gear box 86 and sets of gears 92 and chains 94 drivingly coupling the gear box 86 to the upper one of the motion transmitting member 70 and also driving coupling the latter to the lower one of the motion transmitting member 70.

The suction dredge pump apparatus 10 having the above-described construction functions as follows. The expansion of each drum 52 causes a vacuum condition within a respective one compartment 30 of the manifold 12 as indicated by the arrow in FIG. 3. This causes vacuum suction flow of the fluid mixture, such as water, sand, gravel and dirt, from the intake chamber 32 through the respective intake valve 34 into the respective compartment 30. Conversely, the contraction of each drum 52 applies positive pressure within a respective one compartment 30 as indicated by the arrow in FIG. 3. This causes positive pressurized flow of the fluid mixture from each compartment 30 through the respective outlet valve 236 to the discharge area.

A relatively uniform flow of fluid mixture from the source S to the discharge area D is achieved because the expansion and contraction of the each of the four drum 52 is timed to occur at different successive time intervals thereby causing vacuum suction flow into and pressurized flow out of each of the four separate compartments 30 at different successive time intervals. As is shown in FIGS. 2 and 4, the upper left one of the drums 52 is fully contracted, thus positive pressurized flow out of the extreme left one of the compartments 30 has ended and vacuum suction flow therein is ready to begin. As indicated by the downward arrow, the lower left one of the drums 52 is contracting thereby causing positive pressurized flow of the fluid mixture from the second from the left one of the compartments 30 to the discharge area D. As indicated by the upward arrow, the lower right one of the drums 52 is expanding thereby causing vacuum suction flow of the fluid mixture into the second from the right one of the compartments 30 from the source S. The upper right one of the drums 52 is shown fully expanded, thus vacuum suction flow into the extreme right one of the compartments 30 has ended and positive pressurized flow therefrom is ready to begin. Thus, at any given point during the rotation cycle of the drive arrangement 80, there is vacuum suction flow into at least one of the compartments 30 and positive pressurized flow out of at least another one of the compartments 30.

As an alternative within the purview of the present invention, the closures 40, 46 of the respective inlet and outlet valves 34, 36 can be operated between opened and closed conditions by other suitable mechanisms, such as solenoids or hydraulic actuators. The activation of such other mechanisms can be controlled by suitable sensors, such as limit switches, which can sense the movement of the drums 52 between their respective expanded and contracted conditions or the angular movement of the respective crank arms 74 during each revolution cycle.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A suction dredge pump apparatus for pumping a fluid mixture of water, sand, gravel and dirt, said pump apparatus comprising:

(a) a manifold including (i) a body defining a plurality of compartments separate from one another, each of said compartments having first and second opposite ends and a bottom extending between said first and second opposite ends and inclined downward from said first end to said second end of said each compartment, (ii) a plurality of intake valves each disposed at said first end of a respective one of said compartments of said body to provide flow communication from a source of the fluid mixture exterior of said body through said each intake valve into said respective one of said compartments of said body, and (iii) a plurality of outlet valves each disposed at said second end of a respective one of said compartments of said body to provide flow communication from each of said compartments to a discharge area exterior of said body such that a flow of the fluid mixture entering said compartments of said body through said intake valves from the source exterior of said body will flow by gravity down said inclined bottom of said body and exit said compartments through said outlet valves to the discharge area; and (b) pump means connected to each of said compartments of said manifold body for producing a vacuum condition and a positive pressurized condition at separate times in each of said compartments and for cycling between said vacuum condition and said positive pressurized condition so as to cause entry of the flow of the fluid mixture into each of said compartment via a corresponding one of said intake valves upon producing said vacuum condition therein and exit of the flow of fluid mixture from each of said compartments via a corresponding one of said outlet valves upon producing said positive pressurized condition therein, said pump means including (i) a plurality of drums deformable between expanded and contracted conditions and having opposite ends which are sealably closed, each of said drums including a deformable vehicle tire carcass and a pair of plate members attached to and sealably closing opposite ends of said tire carcass to form said opposite ends of said drum, (ii) a plurality of conduits each extending between and connected to tops of said compartments of said manifold body and one of said closed ends of said drums, and (iii) actuating means connected to the other of said closed ends of said drums for producing deformation of said drums between said expanded and contracted conditions so as to cause vacuum suction flow of the fluid mixture into said compartments of said manifold body via said intake valves and pressurized flow of the fluid mixture from said compartments of said manifold body via said outlet valves.

2. The apparatus of claim 1 wherein said manifold also includes an intake chamber connected to said body adjacent to and extending along said first ends of said compartments of said body, said intake chamber having an inlet for connecting to the source of fluid mixture external of said body.

3. The apparatus of claim 1 wherein said pump means is operable for cycling said respective compartments of said manifold body between said vacuum and positive pressurized conditions at different successive time intervals to produce a relatively continuous flow of the fluid mixture through said manifold from the source of the fluid mixture to the discharge area.

4. The apparatus of claim 1 wherein each of said intake valves is disposed relative to said respective one compartment to assume an opened position in response to said pump means producing of said vacuum condition in said respective one compartment and a closed position in response to said pump means producing said positive pressurized condition in said respective one compartment.

5. The apparatus of claim 1 wherein each of said outlet valves is disposed relative to said respective one compartment to assume a closed position in response to said pump means producing said vacuum condition in said respective one compartment and an opened position in response to said pump means producing said positive pressurized condition in said respective one compartment.

6. The apparatus of claim 1 wherein said body of said manifold includes a top wall, a bottom wall, a pair of opposite side walls interconnecting said top and bottom walls, and a pair of opposite upper and lower end walls interconnecting said top and bottom wall and said opposite side walls, said bottom wall of said body sloping downward from said upper end wall to said lower end wall and defining said bottoms of said compartments therein, said upper and lower end walls of said body defining said first and second ends of said compartments therein.

7. The apparatus of claim 6 wherein said body of said manifold also includes a plurality of partition walls interconnecting said upper and lower end walls and said top and bottom walls and being spaced apart from one another and from said opposite side walls of said body so as to define said plurality of compartments therebetween.

8. The apparatus of claim 1 wherein each of said intake valves includes:

means defining an inlet opening in said first end of said respective one compartment; and a closure member mounted to said body of said manifold adjacent to said first end of said respective one compartment to undergo movement to an opened position relative to said inlet opening in response to said vacuum condition being produced in said respective one compartment and a closed position relative to said inlet opening in response to said positive pressurized condition being produced in said respective one compartment.

9. The apparatus of claim 8 wherein said intake valves are flapper valves, said closures of said intake valves being flexible so as to move between said opened and closed positions relative to said inlet openings thereof.

10. The apparatus of claim 6 wherein each of said outlet valves includes:

means defining an outlet opening in said second end of said respective one compartment; and a closure member mounted to said body of said manifold adjacent to said second end of said respective one compartment to undergo movement to a closed position relative to said outlet opening in response to said vacuum condition being produced in said respective compartment and an opened position relative to said outlet opening in response to said positive pressurized condition being produced in said compartment.

11. The apparatus of claim 10 wherein said outlet valves are flapper valves, said closures of said outlet valves being flexible so as to move between said opened and closed positions relative to said outlet openings thereof.

12. The apparatus of claim 1 wherein said actuating means is operable for cycling said respective drums between said expanded and contracted conditions at different successive time intervals to produce a relatively continuous flow of the fluid mixture through said manifold from the source of fluid mixture to the discharge area.

13. The apparatus of claim 1 wherein said pump means further includes a frame, each of said drums being supported on said frame at said one end of said drum to which a respective one of said conduits is attached, each of said other ends of said drums being free to move relative to said frame to deform said drums between said expanded and contracted conditions.

14. The apparatus of claim 13 wherein said actuating means includes:

a plurality of guide members each respectively attached to said frame adjacent to and spaced from said other end of a respective one of said drums; and plurality of axial guide rods each attached to a said other end of said respective one drum and extending through a respective one of said guide members so as to restrict said other end of said respective one drum to axial movement between said expanded and contracted conditions.

15. The apparatus of claim 13 wherein said actuating means includes:

a plurality of motion transmitting members being rotatably supported on said frame; and a plurality of links each pivotally interconnecting one of said motion transmitting members to said other end of a respective one of said drums for producing deformation of said respective drum between respective expanded and contracted conditions during each cycle of rotation of said motion transmitting members so as to cause vacuum suction flow of the fluid mixture into said compartments of said manifold body via said intake valves and and pressurized flow of the fluid mixture from said compartments via said outlet valves at different successive time intervals during each said rotation cycle.

16. The apparatus of claim 15 wherein said actuating means further includes a drive arrangement connected to said motion transmitting members for repetitively rotatably driving said motion transmitting members through said rotation cycle.

17. A suction dredge pump apparatus for pumping a fluid mixture of water, sand, gravel and dirt, said pump apparatus comprising:

(a) a manifold including (i) a body defining a plurality of compartments separate from one another, each of said compartments having first and second opposite ends and a bottom extending between said first and second opposite ends and inclined downward from said first end to said second end of said each compartment, (ii) an intake chamber connected to said body adjacent to and extending along said first ends of said compartments of said body, said intake chamber having an inlet for connecting to a source of the fluid mixture external of said manifold, (iii) a plurality of intake valves each disposed at said first end of a respective one of said compartments of said body to provide flow communication from said intake chamber through said each intake valve into said respective one of said compartments of said body, (iv) a plurality of outlet valves each disposed at said second end of a respective one of said compartments of said body to provide flow communication from each of said compartments to a discharge area exterior of said body such that a flow of the fluid mixture entering said compartments of said body through said intake valves from said intake chamber will flow by gravity down said inclined bottom of said body and exit said compartments through said outlet valves to the discharge area; and (b) pump means connected to each of said compartments of said manifold body for producing a vacuum condition and a positive pressurized condition at separate times in each of said compartments and for cycling between said vacuum condition and said positive pressurized condition so as to cause entry of the flow of the fluid mixture into each of said compartment from said intake chamber via a corresponding one of said intake valves upon producing said vacuum condition therein and exit of the flow of the fluid mixture from each of said compartments to the discharge area via a corresponding one of said outlet valves upon producing said positive pressurized condition therein, said pump means including (i) a plurality of drums deformable between expanded and contracted conditions and having opposite ends which are sealably closed, each of said drums including a deformable vehicle tire carcass and a pair of plate members attached to and sealably closing opposite ends of said tire carcass to form said opposite ends of said drum, (ii) a plurality of conduits each extending between and connected to tops of said compartments of said manifold body and one of said closed ends of said drums, and (iii) actuating means connected to the other of said closed ends of said drums for producing deformation of said drums between said expanded and contracted conditions so as to cause vacuum suction flow of the fluid mixture into said compartments of said manifold body via said intake valves and pressurized flow of the fluid mixture from said compartments of said manifold body via said outlet valves, said actuating means being operable for cycling said respective drums between said expanded and contracted conditions at different successive time intervals to produce a relatively continuous flow of the fluid mixture from the external source through said manifold to the discharge area.

18. The apparatus of claim 17 wherein each of said intake valves includes:

means defining an inlet opening in said first end of said respective one compartment; and a closure member mounted to said body of said manifold adjacent to said first end of said respective one compartment to undergo movement to an opened position relative to said inlet opening in response to said vacuum condition being produced in said respective one compartment and a closed position relative to said inlet opening in response to said positive pressurized condition being produced in said respective one compartment.

19. The apparatus of claim 17 wherein each of said outlet valves includes:

means defining an outlet opening in said second end of said respective one compartment; and a closure member mounted to said body of said manifold adjacent to said second end of said respective one compartment to undergo movement to a closed position relative to said outlet opening in response to said vacuum condition being produced in said respective compartment and an opened position relative to said outlet opening in response to said positive pressurized condition being produced in said compartment.

20. The apparatus of claim 17 wherein said body of said manifold includes a top wall, a bottom wall, a pair of opposite side walls interconnecting said top and bottom walls, and a pair of opposite upper and lower end walls interconnecting said top and bottom wall and said opposite side walls, said bottom wall of said body sloping downward from said upper end wall to said lower end wall and defining said bottoms of said compartments therein, said upper and lower end walls of said body defining said first and second ends of said compartments therein.

21. The apparatus of claim 20 wherein said body of said manifold also includes a plurality of partition walls interconnecting said upper and lower end walls and said top and bottom walls and being spaced apart from one another and from said opposite side walls of said body so as to define said plurality of compartments therebetween.

* * * * *